US010811768B2

(12) United States Patent
Russell et al.

(10) Patent No.: US 10,811,768 B2
(45) Date of Patent: Oct. 20, 2020

(54) ANTENNA SYSTEM AND METHOD FOR AERIAL VEHICLES

(71) Applicant: AERONET GLOBAL COMMUNICATIONS LABS DAC, Dublin (IE)

(72) Inventors: Brian Russell, Dublin (IE); Ronan Farrell, Dublin (IE)

(73) Assignee: AERONET GLOBAL COMMUNICATIONS LABS DAC, Dublin (IE)

( * ) Notice: Subject to any disclaimer, the term of this patent is extended or adjusted under 35 U.S.C. 154(b) by 0 days.

(21) Appl. No.: 16/077,461

(22) PCT Filed: Feb. 13, 2017

(86) PCT No.: PCT/EP2017/053179
§ 371 (c)(1),
(2) Date: Aug. 11, 2018

(87) PCT Pub. No.: WO2017/137634
PCT Pub. Date: Aug. 17, 2017

(65) Prior Publication Data

US 2019/0036213 A1 Jan. 31, 2019

Related U.S. Application Data

(60) Provisional application No. 62/294,522, filed on Feb. 12, 2016.

(30) Foreign Application Priority Data

Feb. 19, 2016 (EP) ..... 16156607

(51) Int. Cl.
*H01Q 3/08* (2006.01)
*H01Q 15/08* (2006.01)
(Continued)

(52) U.S. Cl.
CPC ..... *H01Q 3/08* (2013.01); *H01Q 1/1257* (2013.01); *H01Q 1/28* (2013.01); *H01Q 3/14* (2013.01);
(Continued)

(58) Field of Classification Search
CPC ..... H01Q 3/08; H01Q 3/14; H01Q 19/062; H01Q 21/0025; H01Q 1/28; H01Q 1/1257; H01Q 15/08
(Continued)

(56) References Cited

U.S. PATENT DOCUMENTS 5,929,819 A 7/1999 Grinberg
6,362,795 B2 * 3/2002 Ishikawa ..... G01S 7/032 343/753
(Continued)

FOREIGN PATENT DOCUMENTS

DE 3840451 A1 6/1990

OTHER PUBLICATIONS

PCT/EP2017/053179. International Search Report & Written Opinion (dated Jun. 1, 2017).
(Continued)

*Primary Examiner* — Khai M Nguyen
(74) *Attorney, Agent, or Firm* — Loza & Loza, LLP; Anthony G. Smyth

(57) ABSTRACT

A method for utilising an array of independently controllable dielectric lenses for radio signal to allow a single antenna to be focussed on one location with a highly directive beam or on more than one location thus enable radio links to be formed with multiple locations. Within the array, each lens will consist of a shaped piece of dielectric material that can be independently, or in groups, pointed in such a direction as to change the direction of the radio signals passing through the lens. The lens will have a shape equivalent to a con-
(Continued)

verging lens which may be a convex shape. Other forms of converging lens may be implemented save space and material. The antenna will have a low gain, wide area of reception and may be implemented as a planar metal antenna or as a group of planar antennas in an array. This invention provides a lightweight system for providing high gain antenna performance without the need for a complex antenna array system or the need for multiple transceiver electronics.

14 Claims, 5 Drawing Sheets

(51) Int. Cl.

| | |
|---|---|
| ***H01Q 19/06*** | (2006.01) |
| ***H01Q 3/14*** | (2006.01) |
| ***H01Q 1/12*** | (2006.01) |
| ***H01Q 1/28*** | (2006.01) |
| ***H01Q 21/00*** | (2006.01) |

(52) U.S. Cl.
CPC ..... *H01Q 15/08* (2013.01); *H01Q 19/062* (2013.01); *H01Q 21/0025* (2013.01)

(58) Field of Classification Search
USPC ..... 343/705
See application file for complete search history.

(56) References Cited

U.S. PATENT DOCUMENTS

| | | | | |
|---|---|---|---|---|
| 6,950,061 | B2 * | 9/2005 | Howell | H01Q 1/3275 342/359 |
| 8,515,294 | B2 * | 8/2013 | Britz | H04B 10/90 398/212 |
| 2002/0018022 | A1 | 2/2002 | Ishikawa et al. | |
| 2002/0067314 | A1 | 6/2002 | Takimoto et al. | |

OTHER PUBLICATIONS

Lima et al., Optimization of Mechanically Beam-steerable Lens Antenna Profile for 60GHz Wireless Communications, URSI International Symp, Jun. 1, 2009, pp. 1-4, IEEE, XP031535199.

Costa et al., Compact Beam-Steerable Lens Antenna for 60-GHz Wireless Communications, IEEE Transactions on Antennas and Propagation, Oct. 1, 2009, pp. 2926-2933, vol. 57, No. 10, XP011271539.

Sorensen et al., Efficient and Accurate Modeling of Electrically Large Dielectric Lens Antennas using Full-Wave Analysis, The 8th European Conference on Antennas and Propagation, Apr. 6, 2014, pp. 3021-3024, IEEE, XP032642530.

* cited by examiner

ANTENNA SYSTEM AND METHOD FOR AERIAL VEHICLES

CROSS-REFERENCE TO RELATED APPLICATIONS

This application is the U.S. National Stage of International Patent Application No. PCT/EP2017/053179 filed on Feb. 13, 2017, which claims the benefit of priority from EP Patent Application No. 16156607.0 filed Feb. 19, 2016 and U.S. Provisional Patent Application Ser. No. 62/294,522 filed Feb. 12, 2016, the disclosures of the foregoing applications being incorporated herein by reference in their entirety for all applicable purposes.

FIELD

The invention relates to an antenna system and method.

BACKGROUND

In an antenna system, directional gain is defined as a measure of the antennas ability to receive or transmit an electromagnetic signal in a specific direction.

It is desirable to have high gain in the direction of the object or objects to which a system wishes to communicate, and low gain in all other directions. The low gain reduces the likelihood of receiving unwanted signals and thus interfering with desired signals. The normal method for shaping the emission pattern is to either design the antenna with a shape such that a desired gain pattern is achieved, or alternatively to use an array of antennas whose gain patterns when combined produce a desired pattern.

There exist a number of publications which disclose antennas comprising a single dielectric lens. These include US Patent Publication No. US 2002/018022, German Patent Publication No. DE 38 40 451, a publication entitled "Optimization of mechanically beam-steerable lens antenna profile for 60 GHz wireless communications" by Lima et AI from an IEEE Antennas and Propagation Society International Symposium, 2009, Apsursi '09 (pages 1 to 4), and a paper entitled "Compact Beam-Steerable Lens Antenna for 60-GHz Wireless Communications" by Costa et AI from IEEE transactions on antennas and propagation, IEEE service center, Piscataway, N.J., US vol. 57, no. 10. However, none of these four publications disclose an array of dielectric lenses.

US Patent Publication No. US 2002/067314 discloses an antenna device, communication apparatus and radar module which includes an array of lenses and a single moveable radiation source. However, the array of lenses is a fixed array which presents a defined shape to the radiation source which can not be adjusted.

It is an object to provide an improved antenna system and method.

SUMMARY

According to the present invention there is provided, as set out in the appended claims, a antenna system comprising:

- an antenna adapted for transmitting or receiving an electromagnetic wave or signal; and
- an array of lenses configured to control the direction of the electromagnetic wave or signal, wherein each lens in the array is independently controllable.

Through the use of individually controllable lenses, the beam pattern produced by the array may be configured to produce one or multiple beam patterns from a single radiator. Each beam pattern may be configured to be a focussed beam pattern or a broad beam pattern, depending on the requirements of the antenna system.

In one embodiment the angular position of each lens in the array is independently controllable such that the array of lenses is configurable to produce a plurality of beams.

In one embodiment the plurality of beams comprise one or more of: a focused beam pattern or a broad beam pattern.

In one embodiment the position of a first set of lenses is controllable to produce a first beam and the position of a second set of lenses is controllable to produce a second beam.

In one embodiment the first beam comprises a focused beam pattern configured for detection of a signal from a known remote antenna and the second beam comprises a broad beam pattern configured for detection of a signal from an unknown remote antenna.

In one embodiment the first beam and the second beam are configured to detect a signal received from the same remote antenna, the first beam comprising a main focused beam and the second beam comprising a broad searching beam, and wherein the pattern of the second beam is adjustable from a broad beam to a focused beam if the strength of the signal detected by the second beam is greater than the strength of the signal detected by the first beam.

In one embodiment each lens is a dielectric lens.

In one embodiment each lens is adjustable to redirect the electromagnetic wave in different directions.

In one embodiment a controller is configured to control the position of the array of lenses.

In one embodiment the shape of at least one lens in the array is convex shaped.

In one embodiment each lens can be individually rotated about an axis.

In one embodiment the array of lenses is configured to direct the electromagnetic wave in a plurality of different directions In one embodiment the controller is adapted to determine the optimal position of each lens.

In one embodiment the controller receives an input of a desired directional gain of said signal and configures the array of lenses to maintain the desired directional gain.

In one embodiment the controller is adapted for shaping the antenna beam pattern using the array of individually controlled dielectric lenses.

In one embodiment there is provided a module to search for emission sources and link optimisation without disrupting ongoing uses or communications.

In one embodiment the system comprises a module to monitor one or more moving emission sources and adjusting the at least one lens to maintain an optimal link with the moving source.

In one embodiment there is provided a method for utilising an array of independently controllable dielectric lenses for radio signal to allow a single antenna to be focussed on one location with a highly directive beam or on more than one location thus enable radio links to be formed with multiple locations.

In one embodiment each lens can consist of a shaped piece of dielectric material that can be independently, or in groups, pointed in such a direction as to change the direction of the radio signals passing through the lens. The lens will have a shape equivalent to a converging lens which may be a convex shape. Other forms of converging lens may be implemented save space and material.

The antenna will have a low gain, wide area of reception and may be implemented as a planar metal antenna or as a group of planar antennas in an array. This invention provides a lightweight system for providing high gain antenna performance without the need for a complex antenna array system or the need for multiple transceiver electronics.

The invention is for a method to shape the electromagnetic emission pattern to or from an antenna into a variety of shapes.

There is also provided a computer program comprising program instructions for causing a computer program to carry out the above method which may be embodied on a record medium, carrier signal or read-only memory.

In another embodiment of the invention there is provided an antenna system comprising:

an antenna adapted for transmitting or receiving an electromagnetic wave or signal; and at least one lens configured to control the direction of the electromagnetic wave or signal.

In one embodiment there is provided a plurality of lenses arranged in an array configuration.

In one embodiment each of the lenses of the plurality of lenses are independently controlled.

BRIEF DESCRIPTION OF THE DRAWINGS

The invention will be more clearly understood from the following description of an embodiment thereof, given by way of example only, with reference to the accompanying drawings, in which:—

DETAILED DESCRIPTION OF THE DRAWINGS

Figure 1:
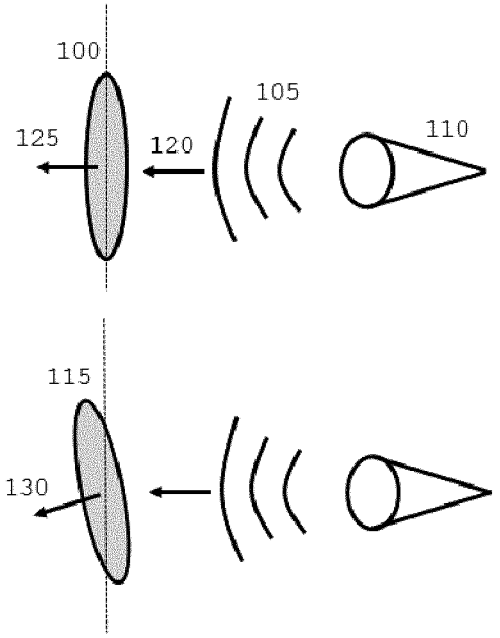
FIG. 1 illustrates an antenna system illustrating the principal of operation of the invention.

FIG. 1 illustrates a system of an antenna (in this case depicted as a horn antenna) (110) generating an electromagnetic emission (105) that is presented to a dielectric lens (100). At the shown angle, the incident wave direction (120) passes through and remains in its existing direction (125).

In another configuration, the dielectric lens is rotated (115) with respect to the incident wave direction, and this causes the resulting wave direction to be altered. The degree of alteration depends on the construction of the dielectric lens and the angle of incidence.

Figure 2:
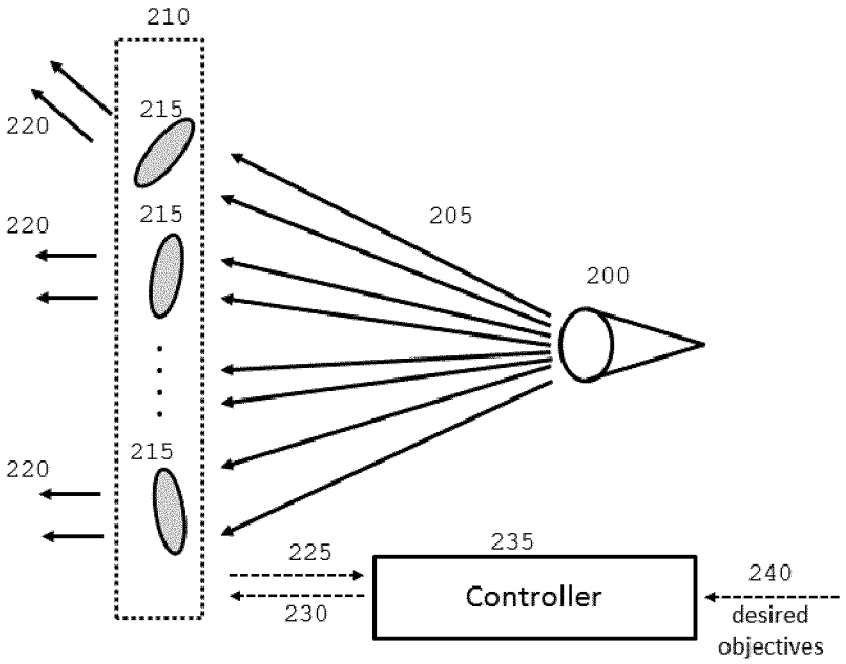
FIG. 2 illustrates an antenna system according to one embodiment of the invention.
Figure 3:
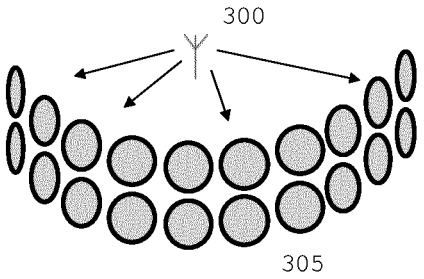
FIG. 3 shows a perspective view of the antenna system of FIG. 2.

FIGS. 2 and 3 illustrate an embodiment of the invention, which comprises an antenna (200;300) and an array (210; 305) of individual dielectric lens (215). In the embodiment shown in FIG. 3, the array of dielectric lenses are arranged to form a surface around the antenna (300). The shape of the surface can be of any suitable shape, such as for example a spherical pattern. It should be noted that the antenna can be an emitter or receiver, and that the behaviour is symmetrical.

Figure 4:
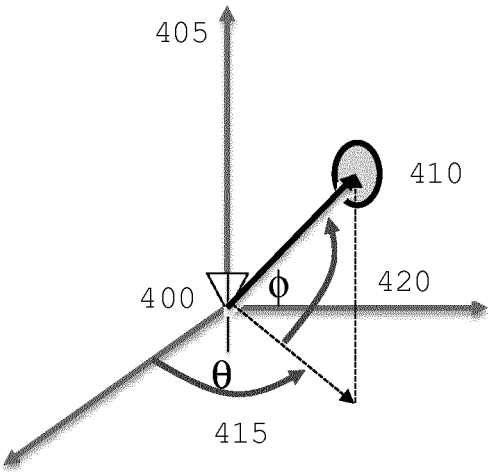
FIG. 4 shows the fixed relationship between a lens and its respective antenna.

Each lens in the array has a fixed relationship with respect to the antenna. As shown in FIG. 4, this relationship can be given by its distance and two angles, representing deviations from some predefined axes, shown as the angle of rotation $\theta$ (415) and the angle of elevation $\phi$ (420) of the dielectric lens (410) relative to the antenna (400).

Each dielectric lens (215) can be independently positioned to provide a different angle to the incoming waveform (205) that is produced by the antenna (200; 300). The effect of the different angles is to provide differing degrees of focusing and refraction to the wave. This can result in the resulting waves being concentrated in one angle or pointing at different angles.

The angle of incidence is defined as the angle of the plane of the lens with respect to the reference plane defined by the antenna and from which the previous pointing angles were defined. There are three angles to fully capture the relationship.

The position of the individual lenses is managed by a controller (235) which receives information about the current position of the lenses (230) and the desired objectives for the antenna system (240). This objective may be for example a simple single-beam solution, such as would be generated by a parabolic dish. Alternatively, the objective may be a more complex multiple-beam pattern, such as one not easily achievable with existing antennas.

The controller is able to calculate the individual impact on the incident electromagnetic waves of each lens from knowledge of the fixed relationship between the lens and the antenna, the dynamic pointing angles of each individual lens, the shape of each lens, and the frequency of the incident electromagnetic wave.

The controller then utilises this knowledge of the available dielectric lenses and their respective location to generate individual settings for each lens, such that the aggregate effect of the lens-refraction on the electromagnetic signal provides the desired objective beam pattern for the antenna system after spatial recombining a distance away from the lens. In this regard, spatial recombining is typically fully achieved at a distance approximately ten times that of the width of the array. The lens settings can then be updated dynamically in accordance with changes in the desired objective.

Figure 5:
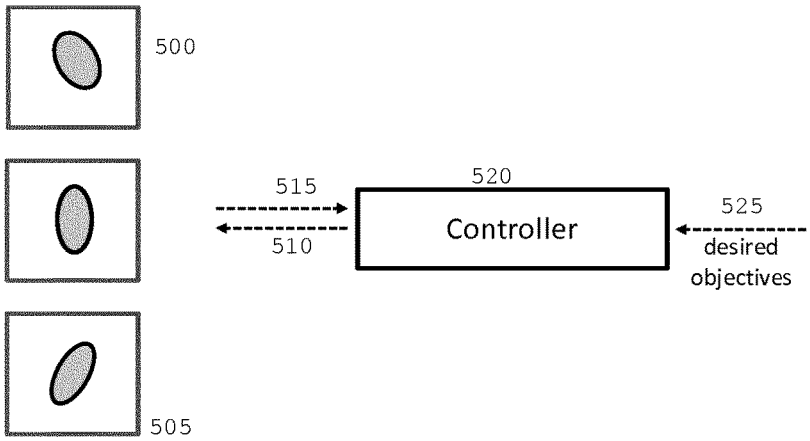
FIG. 5 illustrates the interaction between the control signals and the lenses of the antenna system.

As shown in FIG. 5, once the individual settings are generated for each lens in the array to satisfy the desired objective beam pattern (525), the controller (520) provides commands to a mechanism (505) that adjusts the position of each lens (500) to its required setting. This is achieved by some or all of the lenses receiving a control signal (510) from the controller (520) directing the lens to move to a specific angular position, and to alter its angle of incidence to the required specification. The angle of incidence can be altered by any suitable mechanism—such as for example by motorised gimbals. The angles of incidence set by this mechanism (505) can then be reported to the controller (520), as illustrated by the arrow 515 in FIG. 5.

It should be noted that a lens may have limitations on the range of available angular movement, which may in turn constrain the beam pattern that can be achieved by the system. In this scenario, an iterative approach can be used to minimise the errors between the desired and achievable beam patterns based on a user defined performance metric. Some exemplary methods for optimising the beam pattern include least mean squares, genetic algorithms, or neural network techniques.

It will be appreciated that the invention takes advantage of the refractive effect that some materials have on electromagnetic signals. In the same way as glass and optical signals, some materials have an ability to refract a radio wave due to the differences in permittivity. Given such a material, it is possible to construct a variety of shapes that can act as lenses that can bend the electromagnetic signal, as the shape of each dielectric lens will have an impact on the lensing effect it will have on the electromagnetic signal. One example of such a shape is a convex disk, but many other shapes are equally viable. It should also be noted that the lenses do not need to be of uniform size or shape. For example, it may be optimal to use a larger lens for parts of the surface further away from the main emission pattern of the antenna, so as to achieve a concentration effect for weaker emissions.

Accordingly, both the shape of the lens and the material used will determine the degree and type of signal modification which will be achieved. This effect is known, and dielectric lenses have been used to focus electromagnetic emissions in a variety of applications.

It will be appreciated that while the described embodiment of the invention discusses the behaviour of the system in the context of an electromagnetic emission, however the behaviour is invertible and will work in a similar fashion for receiving a signal.

The antenna system of the present invention makes use an array of dielectric lens that can be individually rotated to present a different angular aspect to the emission source. The lens may vary in size and behaviour. Depending on the angle of the lens to the emission source, the electromagnetic signal will be bent in different directions, as illustrated in FIGS. 1 and 2. In effect the invention provides an independently controllable lens or array of lenses configured to redirect the electromagnetic emissions in different directions, either combining to produce one or more focussed beams with high gain, or alternatively providing a wide angle of emission.

The antenna system preferably comprises an array of dielectric lenses which together can be used to construct a controllable manipulation of an electromagnetic emission. It is envisaged that the system can be used as part of an antenna system, but it is not an antenna and has no ability to transmit or receive electromagnetic emissions. The design of the antenna and the technology used is independent of the dielectric lens and its effect on the electromagnetic emissions.

The shape and structure of the array can vary, and can thus be adapted for a different number of lenses, to fit a specific available space or form-factor, or for other design reasons.

The position of each lens in the array may be permanently configured to produce a static pattern transformation between the two sides of the lens. However, as previously noted, there are benefits that can be achieved by adding a mechanism to allow the lens positions to be modified, either before being put in use, or while in use. In this way, it is possible to adjust the emissions patterns based on the needs at the time. It will be appreciated that any such method requires a means for identifying the current position of the antenna to ensure that the correct positioning is achieved.

In the case where reconfiguration of the dielectric lenses is possible, it is necessary to include a control unit such as the one previously described in relation to FIG. 5, which takes the desired objectives for mapping into a pattern for the directional gain of the overall system, which is an antenna and the lenses. The control unit can then determine the optimal position of each lens based on the desired results and the lensing behaviour of each lens. This controller can then send the desired positions to the individual lenses, and then measure and ensure that those positions are maintained.

In the case where the desired objective is to target a specific location, the controller may interpret this requirement to provide the equivalent system performance. If either the lens or the target is part of a mobile entity, this would need to be continuously updated.

Figure 6:
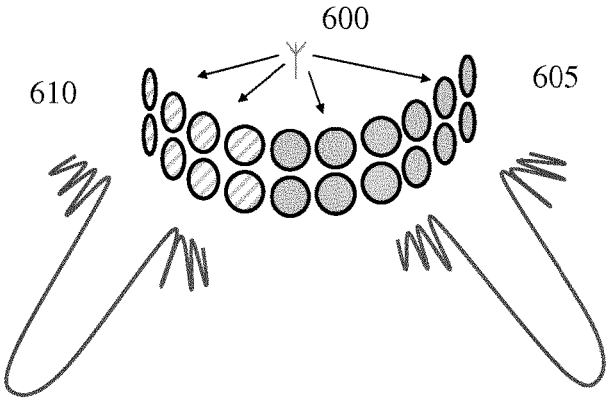
FIG. 6 provides an exemplary illustration of how the individual lenses of the array may be configured where the desired objective of the system is to direct the antenna beam pattern in multiple directions.

FIG. 6 provides an exemplary illustration of how the individual lenses of the array may be configured where the desired objective of the system is to direct the antenna beam pattern in multiple directions. In this case, the individual dielectric lenses have been divided into different groups, including group 605 and group 610. Contiguous groupings may be easiest from a calculation perspective, but non-contiguous groupings with non-adjacent lens are also viable, and may offer advantages in some applications. The lenses in each of these groups are adjusted to act as an independent focusing unit to create a customised beam pattern, such as for example a focussed beam in a specific direction. It should be appreciated that each beam pattern is independent of the beam pattern generated by a different grouping of lenses.

In one use, it is possible to utilise one dielectric lens from the array to undertake a search pattern to identify different emission sources. In this case, the controller would command the identified lens to present a range of angles to the antenna such that it describes a field of view matching the search objectives. The signal passing through the lens may be focussed onto the same receiving antenna or onto a different antenna, and then subsequently analysed to identify the emission source and the optimal pointing angle for the lens.

Figure 7:
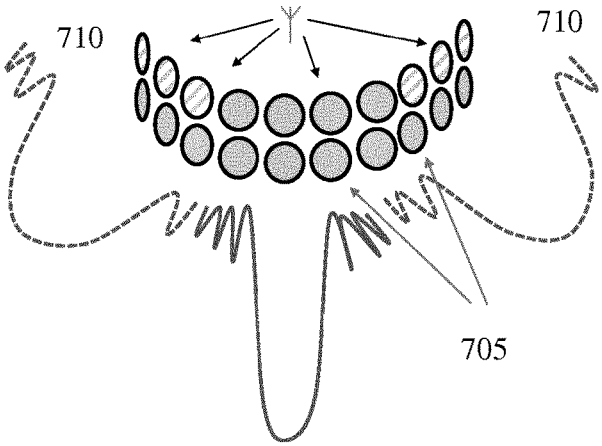
FIG. 7 shows an exemplary illustration of how the individual lenses of the array may be configured such that one set of lenses is configured to produce a focussed beam pattern and another set of lenses is configured to produce a broad beam search pattern.

In the scenario where it is desired to achieve connectivity between two different sets of antennas (one known and one possibly unknown), the array of lenses can also be adjusted so that a set of lenses maintains high receptivity in the direction of the known antenna, as illustrated by group 705 in FIG. 7. A search pattern can then be configured where a combination of the other lenses sweep the range of possible locations attempting to sense a signal. The optimal pattern in this scenario is a wide beam with lower receptivity, enabling easier detection of another emitter, as illustrated by group 710 in FIG. 7. Where a signal has been sensed, the searching lenses can be then configured to form a high gain/receptivity beam pattern pointing towards the newly discovered antenna.

This approach can be extended to the challenge of maintaining an optimal signal link to a remote antenna. In this case, the majority of the lenses in the array are configured to ensure maximal antenna performance to the remote antenna in a specific pointing angle. By selecting a subset of lenses, it is possible to sweep adjacent pointing angles for the antenna to assess whether an adjustment in the angle is required to achieve maximal performance.

Assessment of a better pointing angle can be achieved by monitoring the received signal strength for each of the search lenses. When a stronger signal is detected, then a decision can be made by the controller to shift the focus of the main beam pattern to the new pointing angle, corresponding to the angle at which the stronger signal was detected. This can be done dynamically and repeatedly in order to track a dynamic target.

Accordingly, where the system of the invention is being used as a means for optimising an existing link, once the correct pointing angle has been found, this can then be used to update all the corresponding lens' positions. This approach does not impact on the continued functionality of the ongoing communications while the search and link optimisation is underway.

In the case where the antenna comprises an array of antennas, the array of dielectric lens forming the surface may be adjusted to direct electromagnetic signals to or from specific areas in the antenna array. This provides additional options for beam-forming, MIMO applications, or beam optimisation.

Figure 8:
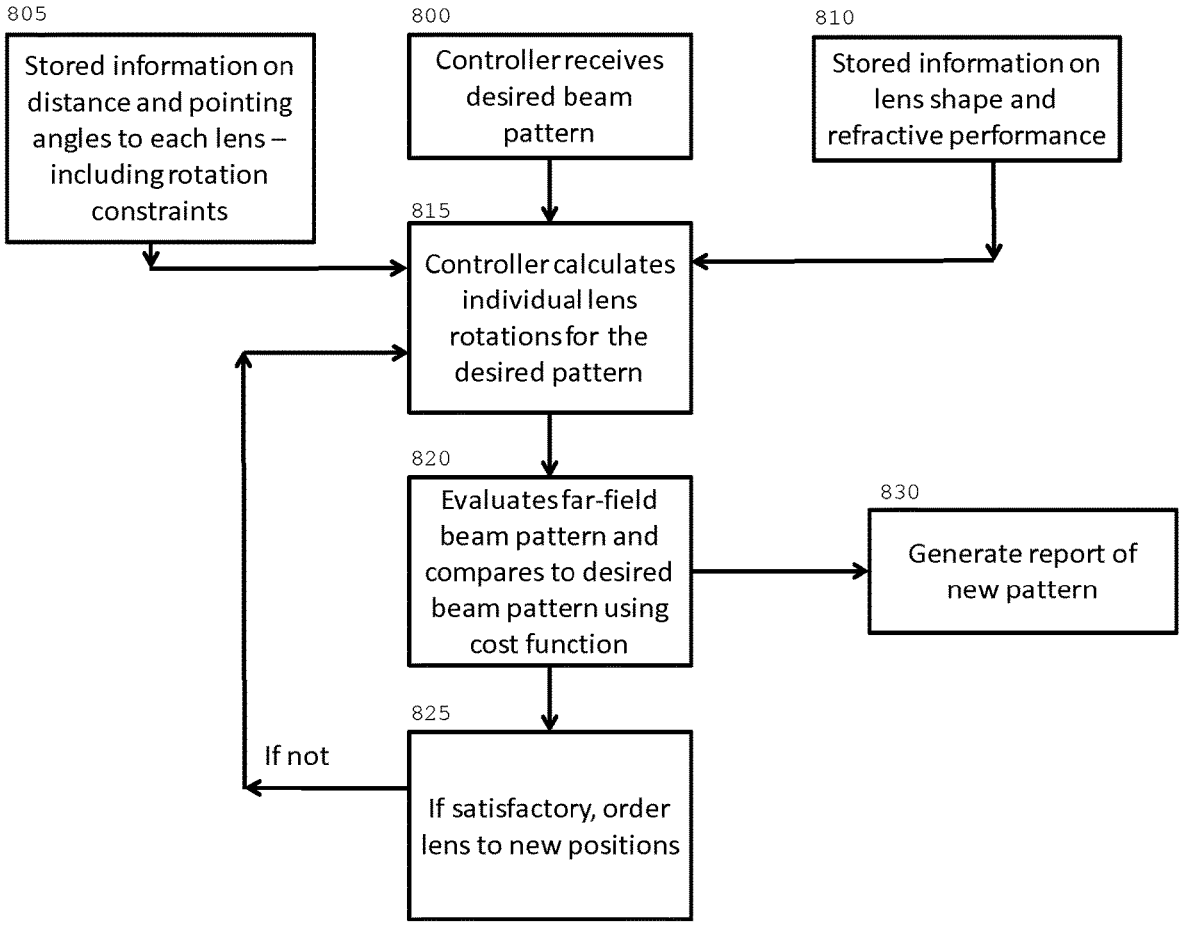
FIG. 8 shows a flowchart of the main steps in the process flow of the invention when being configured to produce a specific beam pattern.

FIG. 8 shows a flowchart of the main steps in the process flow of the invention when the desired objective is to produce a specific beam pattern. In step 800, the controller receives the desired beam pattern. In step 815, the controller calculates the individual lens rotations or settings required to achieve the desired pattern, based on stored information in relation to the shape of each lens and its refractive performance (810), as well as stored information on the distance and pointing angles to each lens, including rotation constraints (805).

In step 820, the controller evaluates the far-field beam pattern and compares this to the desired beam pattern using a cost function. A report of this new pattern is then generated (830). If this evaluation is satisfactory, the controller transmits control signals to direct the lenses to their new positions in order to produce the desired beam pattern (step 825). However, if this evaluation is not satisfactory, the controller returns to step 815 and performs a recalculation of the required settings.

Figure 9:
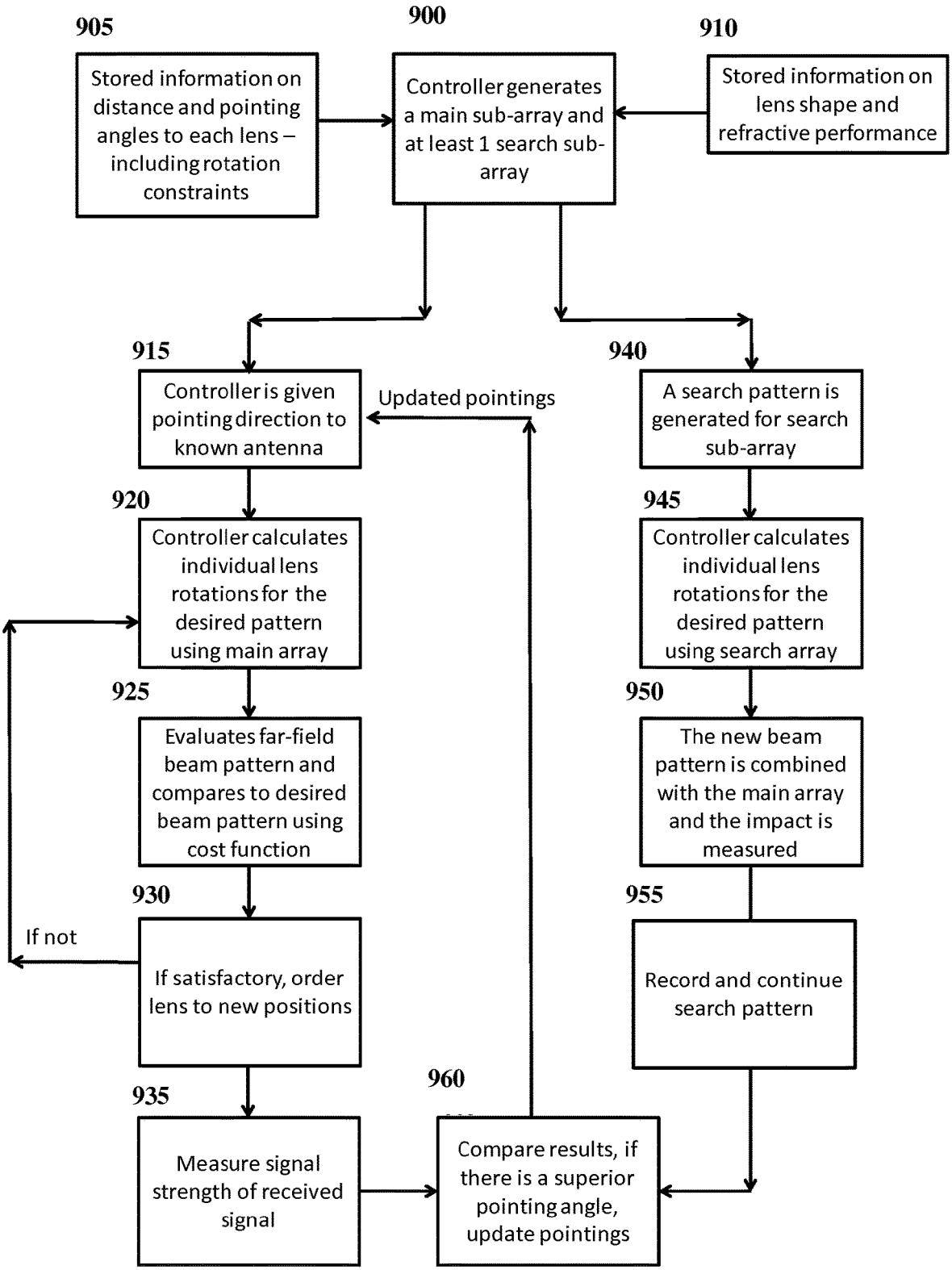
FIG. 9 shows a flowchart of an exemplary search algorithm which may be performed by the present invention.

FIG. 9 shows a flowchart of an exemplary search algorithm which may be performed by the present invention to maintain an optimal signal link with a remote antenna.

In step 900, the controller generates a main sub-array corresponding to a group of lenses which are to be configured to point in the direction of a known antenna, and at least one search sub-array, where each search sub-array corresponds to a group of lenses which are to be configured to search for a better signal from the antenna. These arrays are generated through the use of stored information in relation to the shape of each lens and its refractive performance (910), as well as stored information on the distance and pointing angles to each lens, including rotation constraints (905).

In step 915, the controller is provided with the pointing direction to the known antenna. In step 920, the controller calculates the individual lens rotations or settings of the main sub-array required to achieve the desired pointing direction beam pattern.

In step 925, the controller evaluates the far-field beam pattern for the main sub-array and compares this to the desired beam pattern for the main sub-array using a cost function. If this evaluation is satisfactory, the controller transmits control signals to direct the lenses of the main sub-array to their new positions in order to produce the desired beam pattern (step 930). However, if this evaluation is not satisfactory, the controller returns to step 920 and performs a recalculation of the required setting.

In step 940, a search pattern is generated for the search sub-array. In step 945, the controller calculates the individual lens rotations or settings of the search sub-array required to achieve the desired search pattern. In step 950, the search beam pattern is combined with the beam pattern of the main sub-array and the impact is measured. In step 955, the search pattern is recorded and the search is continued.

In step 935, the signal strength of the signal received from the antenna through the main sub-array is measured. In step 960, the signal strength of the signal received from the antenna through the main sub-array is compared to the signal strength of the signal received from the antenna through the search sub-array. If the results of this comparison indicate that there is a superior pointing angle, the pointing direction of the main sub-array is updated to reflect this pointing angle at step 915.

The embodiments in the invention described with reference to the drawings comprise a computer apparatus and/or processes performed in a computer apparatus or controller as hereinbefore described. However, the invention also extends to computer programs, particularly computer programs stored on or in a carrier adapted to bring the invention into practice. The program may be in the form of source code, object code, or a code intermediate source and object code, such as in partially compiled form or in any other form suitable for use in the implementation of the method according to the invention. The carrier may comprise a storage medium such as ROM, e.g. CD ROM, or magnetic recording medium, e.g. a memory stick or hard disk. The carrier may be an electrical or optical signal which may be transmitted via an electrical or an optical cable or by radio or other means.

In the specification the terms "comprise, comprises, comprised and comprising" or any variation thereof and the terms include, includes, included and including" or any variation thereof are considered to be totally interchangeable and they should all be afforded the widest possible interpretation and vice versa.

The invention is not limited to the embodiments hereinbefore described but may be varied in both construction and detail.

The invention claimed is:

1. An antenna system comprising:

an antenna adapted for transmitting or receiving an electromagnetic wave or signal;

an array of dielectric lenses arranged to form a surface around the antenna and configured to control the direction of the electromagnetic wave or signal, wherein each dielectric lens in the array of dielectric lenses is independently controllable; and a controller in communication with the array of dielectric lenses, wherein the controller is configured to receive position information of the array of dielectric lenses and a desired objective beam pattern of the antenna system and to utilize this information to adjust an angular position of each dielectric lens in the array of dielectric lenses such that the electromagnetic wave or signal incident on the array of dielectric lenses produces a plurality of beams satisfying the desired objective beam pattern.

2. The antenna system of claim 1, wherein the plurality of beams comprise one or more of: a focused beam pattern or a broad beam pattern.

3. The antenna system of claim 1, wherein the position of a first set of dielectric lenses is controllable to produce a first beam and the position of a second set of dielectric lenses is controllable to produce a second beam.

4. The antenna system of claim 3, wherein the first beam comprises a focused beam pattern configured for detection of a signal from a known remote antenna and the second beam comprises a broad beam pattern configured for detection of a signal from an unknown remote antenna.

5. The antenna system of claim 3, wherein the first beam and the second beam are configured to detect a signal received from the same remote antenna, the first beam comprising a main focused beam and the second beam comprising a broad searching beam, and wherein the pattern of the second beam is adjustable from a broad beam to a focused beam if the strength of the signal detected by the second beam is greater than the strength of the signal detected by the first beam.

6. The antenna system of claim 1 wherein each dielectric lens is adjustable to redirect the electromagnetic wave in different directions.

7. The antenna system of claim 1 wherein at least one dielectric lens in the array of dielectric lenses is convex shaped.

8. The antenna system of claim 1 wherein each dielectric lens can be individually rotated about an axis.

9. The antenna system of claim 1 wherein the array of dielectric lenses is configured to direct the electromagnetic wave in a plurality of different directions.

10. The antenna system of claim 1, wherein the controller receives an input of a desired directional gain of said signal and configures each dielectric lens to maintain the desired directional gain.

11. The antenna system of claim 1 comprising a module to search for emission sources and link optimisation without disrupting ongoing uses or communications.

12. The antenna system of claim 1 wherein the system comprises a module to monitor one or more moving emission sources and adjust the array to maintain an optimal link with the moving source.

13. A method for utilising an antenna system comprising an antenna configured to transmit or receive an electromagnetic wave or signal, an array of independently controllable dielectric lenses arranged to form a surface around the antenna and a controller in communication with the array of dielectric lenses, the method being operative to allow the antenna system to be focused on one location with a highly directive beam or on more than one location thus enabling radio links to be formed with multiple locations, the method comprising:

receiving by the controller, position information of the dielectric lenses and a desired objective beam pattern of the antenna system; and utilizing the position information to adjust angular position of each dielectric lens in the array of dielectric lenses such that the electromagnetic wave or signal incident on the array of dielectric lenses produces a plurality of beams satisfying the desired objective beam pattern.

14. A non-transitory computer-readable storage medium having one or more program instructions that, when executed by a controller, cause the controller to:

configure an antenna system to transmit or receive an electromagnetic wave or signal;

configure an array of independently controllable dielectric lenses to cause the antenna system to be focused on one location with a highly directive beam or on more than one location thereby enabling radio links to be formed with multiple locations, wherein the array of independently controllable dielectric lenses is arranged to form a surface around an antenna in the antenna system, and wherein the program instructions further cause the controller to:

receive at a controller, position information of the array of independently controllable dielectric lenses and a desired objective beam pattern of the antenna system; and utilize the information to adjust angular position of each dielectric lens in the array of independently controllable dielectric lenses such that the electromagnetic wave or signal incident on the array of independently controllable dielectric lenses produces a plurality of beams satisfying a desired objective beam pattern.

* * * * *